US005319848A

United States Patent [19]

Schmidt et al.

[11] Patent Number: 5,319,848

[45] Date of Patent: Jun. 14, 1994

[54] APPARATUS FOR ATTACHING FASTENERS TO MATERIAL

[76] Inventors: Volker Schmidt, 4638 Todds Rd.; Erich A. Schmidt, 2415 Liberty Rd., both of Lexington, Ky. 40509

[21] Appl. No.: 84,024

[22] Filed: Jun. 30, 1993

[51] Int. Cl.[5] ..... B23P 21/00; B23Q 7/10; A41H 37/04

[52] U.S. Cl. ..... 29/787; 29/818; 227/18

[58] Field of Search ..... 29/771, 787, 788, 809, 29/818; 227/15, 18, 19, 20, 30, 119, 139

[56] References Cited

U.S. PATENT DOCUMENTS 3,750,925 8/1973 Schmidt et al. ..... 227/18
3,964,661 6/1976 Schmidt et al. ..... 227/18
3,987,950 10/1976 Schmidt et al. ..... 227/116
4,605,150 8/1986 Ikehara ..... 227/18
4,606,487 8/1986 Douri ..... 227/18
4,615,473 10/1986 Taga ..... 227/15
4,703,882 11/1987 Herten ..... 227/18
4,799,611 1/1989 Taga ..... 227/119
4,985,987 1/1991 Schmidt et al. ..... 227/18

*Primary Examiner*—Timothy V. Eley
*Assistant Examiner*—David P. Bryant
*Attorney, Agent, or Firm*—Frank C. Leach, Jr.

[57] ABSTRACT

Two mating fastener elements are attached to material at a setting station through a first electric motor. The motor rotates a cam for causing a first pivotally mounted arm to move a support, which supports one of the fastener elements, towards a ram, which is moved by a second pivotally mounted arm attached to the cam rotated by the motor. A second electric motor, which makes at least one revolution and may make a plurality of revolutions during each energization of the first motor, is energized when the first motor, which makes one revolution during each energization, is energized. Each of two hoppers has a plurality of one of the fastener elements. The second motor activates a knife blade in each of the two hoppers so that one of the knife blades moves upwardly in its hopper while the other is moving downwardly to feed the fastener elements within the hopper therefrom for receipt by the support or the ram.

20 Claims, 7 Drawing Sheets

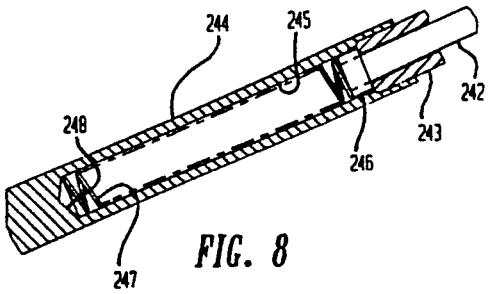
FIG. 8
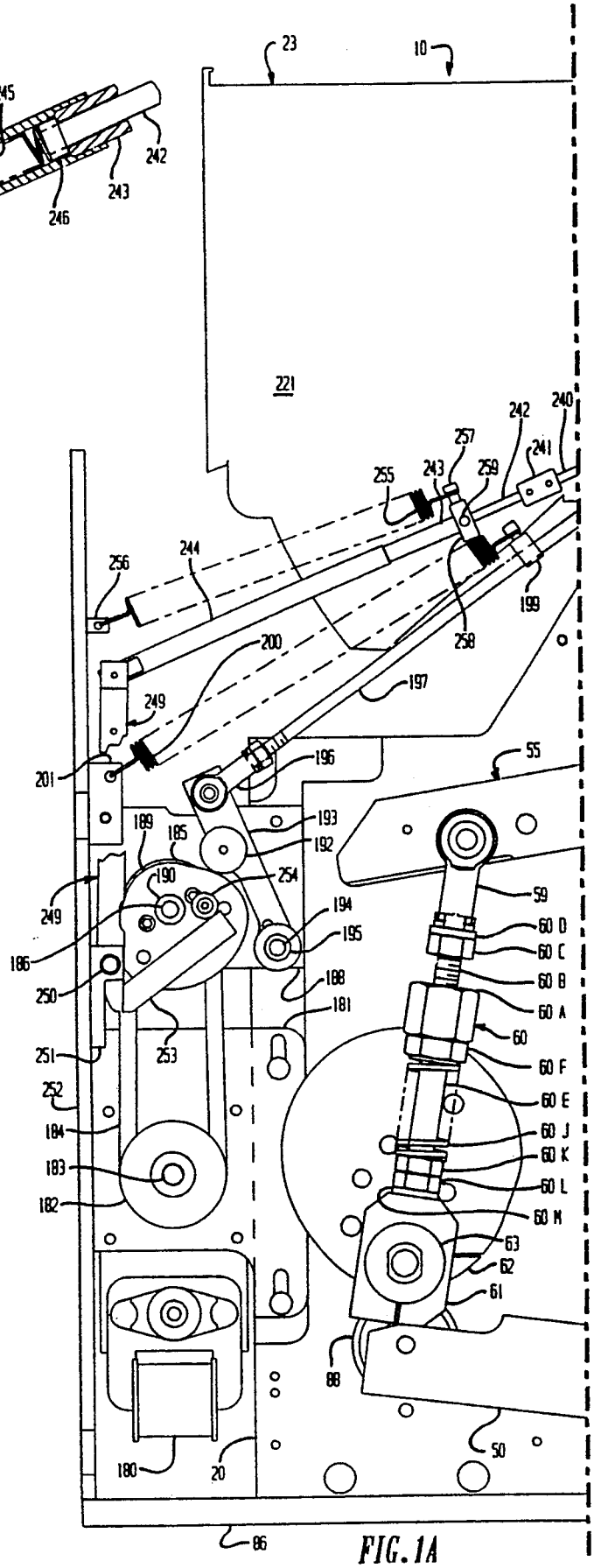
FIG. 1A
| FIG. 1A | FIG. 1B |
|---|---|
FIG. 1

FIG. 2
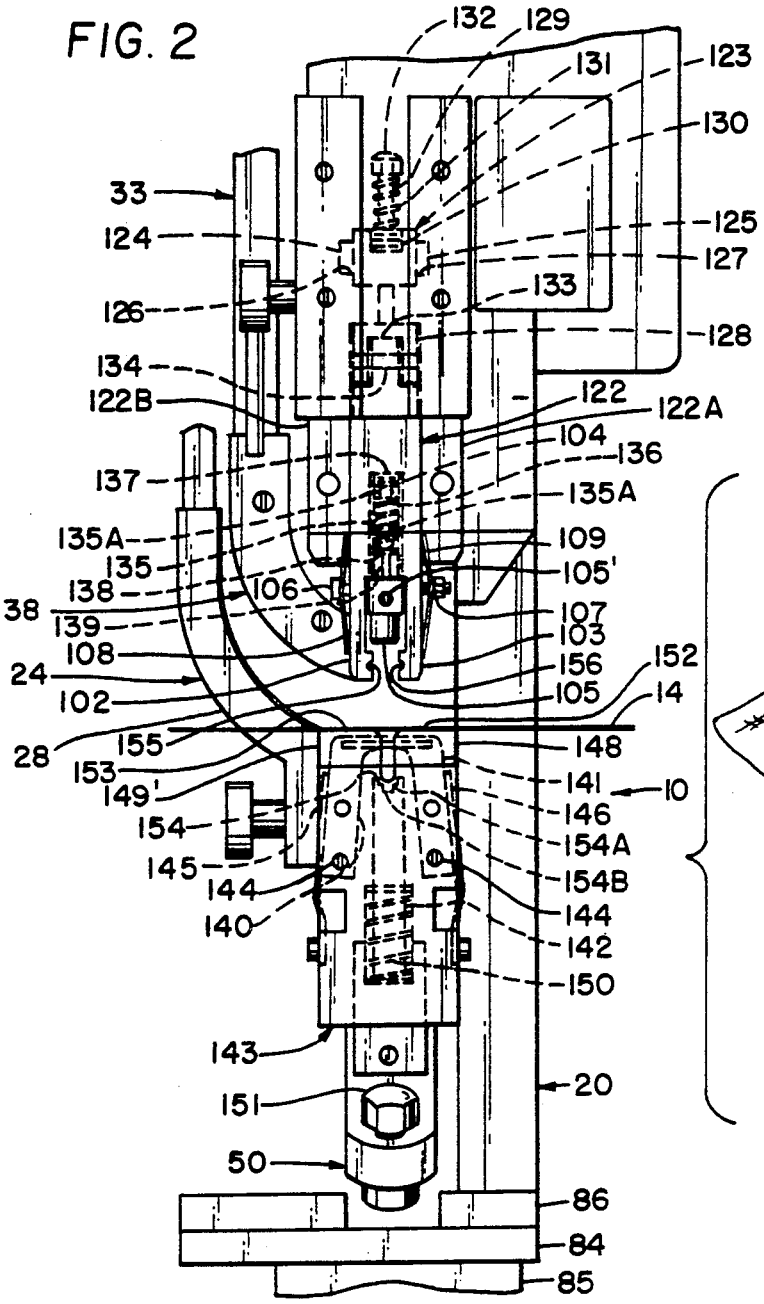
FIG. 3
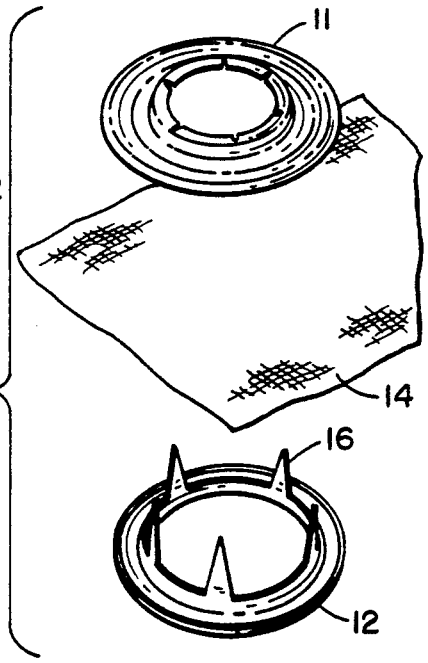
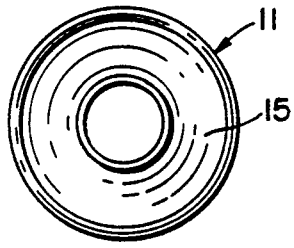
FIG. 12
FIG. 13
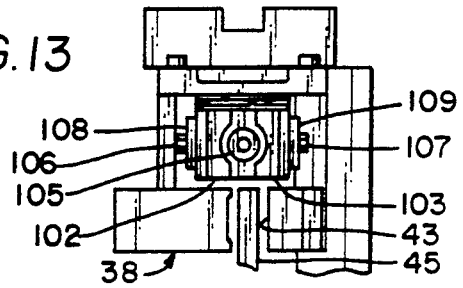

FIG. 5
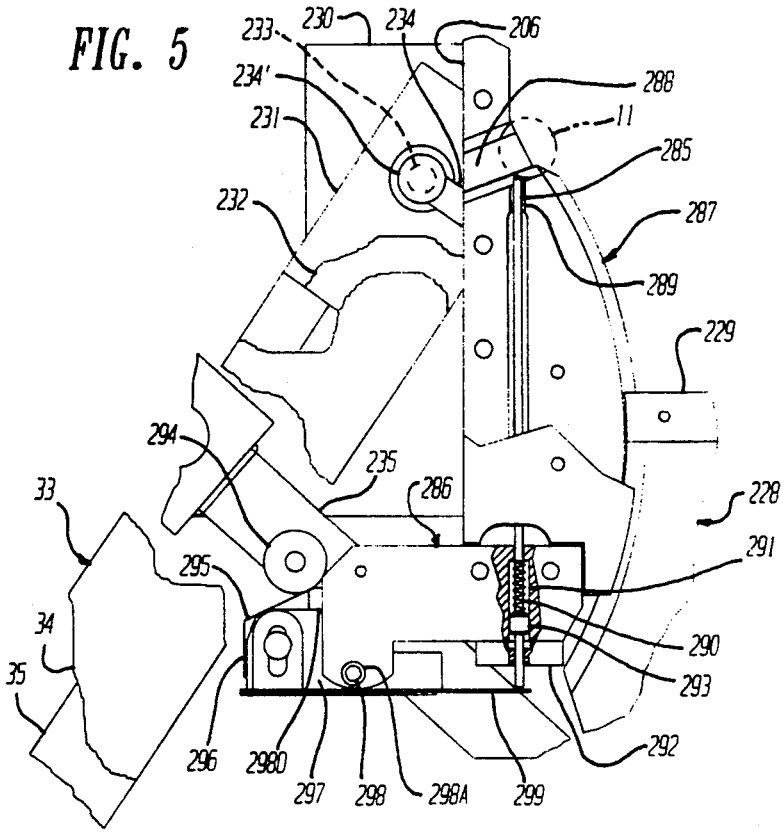
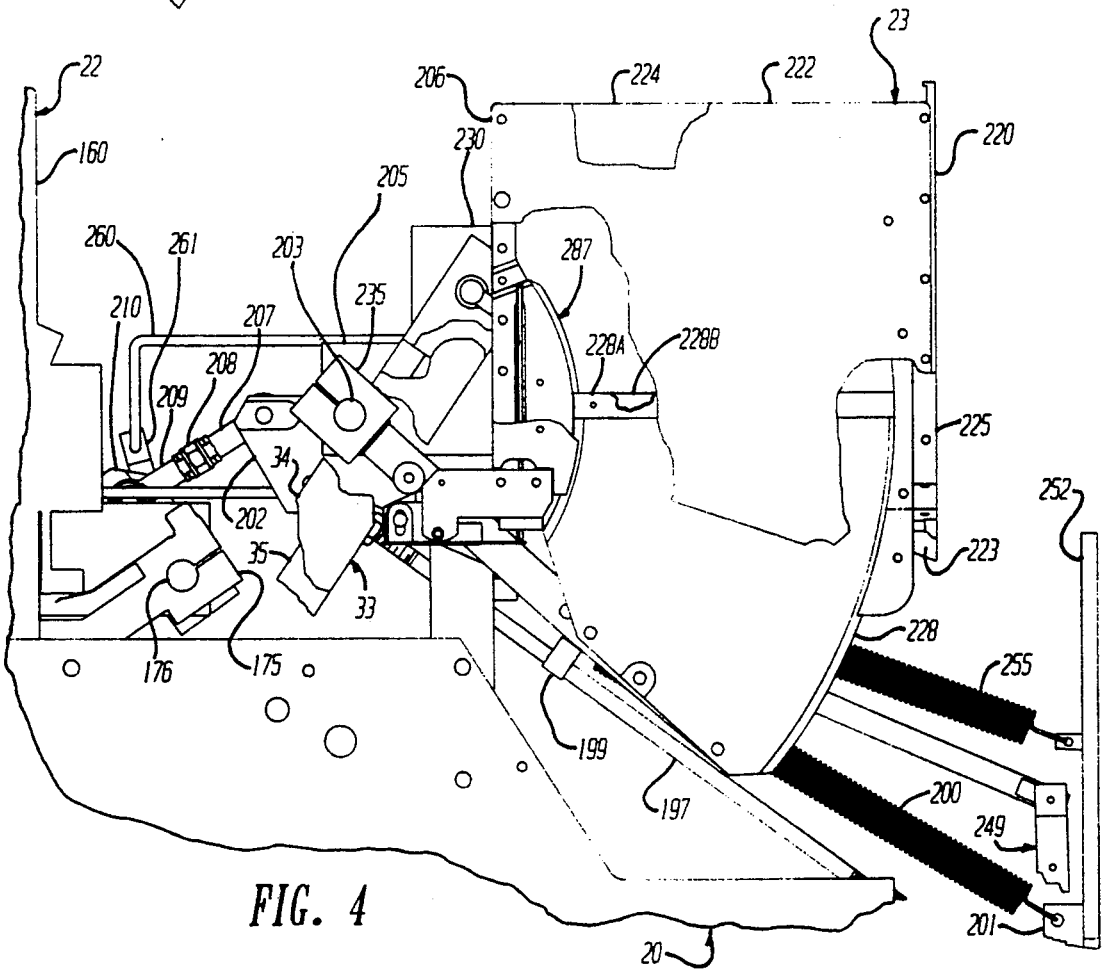
FIG. 4

APPARATUS FOR ATTACHING FASTENERS TO MATERIAL

This invention relates to an attaching apparatus for attaching two mating fastener elements to each other and to a material and, more particularly, to an attaching apparatus having a single power source for causing the attachment of the two mating fastener elements to each other and to the material.

Each of U.S. Pat. Nos. 3,750,925, 3,803,698, 3,964,661, 3,987,950, and 4,985,987 to Schmidt et al, which are incorporated by reference herein, attaches mating fastener elements to each other and to material. Each of the aforesaid Schmidt et al patents employs two separate power sources for moving two mating fastener elements towards each other for attachment to each other and to material. Each of the aforesaid Schmidt et al patents has two separate hoppers supplying the two separate mating fastener elements to a setting station at which they can be attached to each other and to the material.

The activating means utilized on commercial products covered by the aforesaid Schmidt et al patents has been a separate air cylinder for moving a support for one of the two mating fastener elements and a separate air cylinder for moving a ram to move the other of the two mating fastener elements so that the two mating fastener elements are moved towards each other and the material to join them together. A third air cylinder has been employed to activate a separate knife blade within each of two hoppers to dispose the mating fastener elements in each hopper in a position for transport therefrom to the setting station at which the two mating fastener elements are attached to each other and to the material.

The attaching apparatus of the present invention employs a single power source, which is preferably an electric motor, for moving the two fastener elements into engagement with each other and the material to which they are to be attached. Thus, the single power source controls the motions of support means, which supports and moves one of the two fastener elements, and ram means, which moves the other of the two fastener elements.

The electric motor, which is substantially quieter than air cylinders, is not subjected to any loss of power to one portion of the attaching apparatus. That is, if the electric motor does not function, there is no movement of any portion of the attaching apparatus of the present invention.

The attaching apparatus of the present invention also has the motions of the knife blades within the two hoppers activated from a second power source, which is separate from the first power source. The second power source also is preferably an electric motor, which is energized at least once each time that the first electric motor is energized. Thus, motion of the knife blades within the hoppers is related to activation of the first electric motor.

Additionally, the knife blade driving electric motor may be activated more than once during each cycle of operation of the first electric motor with this selection of the number of activations of the knife blade driving motor being controlled by an operator of the attaching apparatus. For example, through the use of a rheostat, the knife blade driving electric motor can be energized once or a plurality of times during each cycle of operation of the first electric motor. Of course, if the operator of the attaching apparatus again activates the first electric motor before completion of the selected number of cycles of the knife blade driving electric motor, then the selected number of cycles would not be completed during a cycle of operation of the attaching apparatus.

To obtain a more balanced force relationship between the motions of the two knife blades, the attaching apparatus of the present invention connects them to the knife blade driving motor so that one of the knife blades is moving upwardly within its hopper while the other of the knife blades is moving downwardly within its hopper. This motion of the two knife blades in opposite directions produces a better balanced relation of the moving parts of the attaching apparatus of the present invention.

The attaching apparatus of the present invention preferably drives the support means and the ram means from the first electric motor through two separate pivotally mounted arms. One of the pivotally mounted arms causes movement of the support means, and the other of the pivotally mounted arms causes movement of the ram means.

An object of this invention is to provide an attaching apparatus for attaching two fastener elements to each other and to material through a single power source.

Another object of this invention is to provide a unique hopper arrangement for fastener elements.

Other objects of this invention will be readily perceived from the following description, claims, and drawings.

This invention relates to an attaching apparatus for attaching first and second mating fastener elements to material at a setting station including support means and ram means at the setting station and moving means for creating movement of the support means and the ram means towards each other. The moving means includes a single power source for creating movement of the support means and the ram means towards each other, a first pivotally mounted arm for causing movement of the support means when the single power source creates movement of the first pivotally mounted arm, a second pivotally mounted arm for causing movement of the ram means when the single power source creates movement of the second pivotally mounted arm, and activation control means for controlling activation of each of the first pivotally mounted arm and the second pivotally mounted arm during a cycle of operation of the attaching apparatus. A first hopper has a plurality of first fastener elements therein with the first fastener elements being transported therefrom by first transport means to a position at the setting station in a specific orientation for engagement by one of the support means and the ram means. A second hopper has a plurality of second fastener elements therein with the second fastener elements being transported therefrom by second transport means to a position at the setting station in a specific orientation for engagement by the other of the support means and the ram means. Selective control means controls movement of each of the first pivotally mounted arm and the second pivotally mounted arm by the single power source to attach the first fastener element and the second fastener element to each other at the setting station.

This invention also relates to an attaching apparatus for attaching first and second mating fastener elements to material at a setting station including support means and ram means at the setting station and moving means for creating movement of the support means and the ram means towards each other. A first hopper has a plurality of first fastener elements therein with the first fastener elements being transported therefrom by first transport means to a position at the setting station in a specific orientation for engagement by one of the support means and the ram means. A second hopper has a plurality of second fastener elements therein with the second fastener elements being transported therefrom by second transport means to a position at the setting station in a specific orientation for engagement by the other of the support means and the ram means. First supply means supplies the first fastener elements to the first transport means from the first hopper, and second supply means supplies the second fastener elements to the second transport means from the second hopper. Single moving means moves each of the first supply means and the second supply means so that one of the first supply means and the second supply means supplies fastener elements at a different time than the other of the first supply means and the second supply means with the single moving means including a single power source.

The attached drawings illustrate a preferred embodiment of the invention in which:

FIG. 1 is a block diagram showing the relationship of FIGS. 1A and 1B;

FIG. 1A is a side elevational view of a portion of an attaching apparatus of the present invention;

FIG. 2 is a fragmentary front end elevational view of the attaching apparatus of FIG. 1;

FIG. 3 is a perspective view of a socket, a ring having prongs to which the socket is to be attached, and material through which the prongs pass when the socket and the ring are attached to each other by the attaching apparatus of FIG. 1;

FIG. 4 is an fragmentary rear elevational view of a portion of the attaching apparatus of FIG. 1 including one of the two hoppers of the apparatus for supplying one of the fastener elements and a portion of a driving mechanism for moving a knife blade in each of the hoppers;

FIG. 5 is an enlarged fragmentary elevational view of a portion of FIG. 4;

FIG. 8 is a fragmentary sectional view of a portion of a drive mechanism for preventing build up of fastener elements at the exit of one of the hoppers;

FIG. 12 is a plan view of one side of one of the fastener elements;

FIG. 13 is a fragmentary bottom plan view of a portion of the attaching apparatus of FIG. 1 and showing a guide channel within which each socket enters the feed chute prior to the socket being disposed at a setting station and a feed in finger disposed in the guide channel;

Figure 1B:
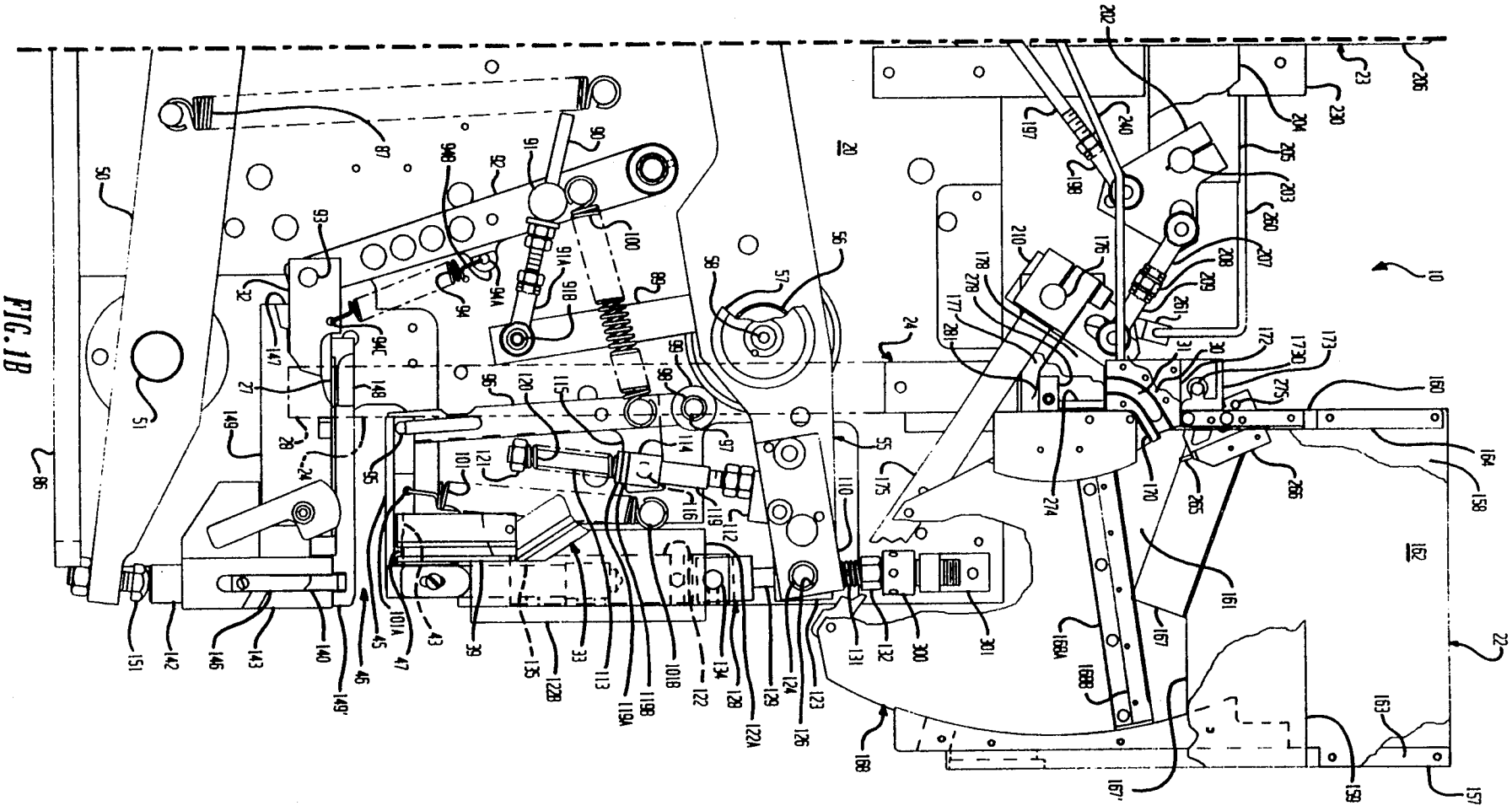
FIG. 1B is a side elevational view of the remainder of the attaching apparatus of FIG. 1A.

Referring to the drawings and particularly FIGS. 1A and 1B, there is shown an attaching apparatus 10 for attaching two mating fastener elements such as a socket 11 (see FIG. 3) and a ring 12 to each other with a material 14 therebetween. The socket 11 includes an annular recess 15 (see FIG. 12) to receive prongs 16 (see FIG. 3) extending from the ring 12 when the socket 11 and the ring 12 are attached to each other.

It should be understood that the mating fastener elements may be other than the socket 11 and the ring 12. For example, the mating fastener elements could be a post and a stud. The attaching apparatus 10 (see FIGS. 1A and 1B) is capable of attaching any two mating fastener elements to each other with the material 14 (see FIG. 3) therebetween.

The attaching apparatus 10 (see FIG. 1B) includes a plate-like support 20 having hoppers 22 and 23 (see FIG. 1A) mounted at its upper end. In a manner similar to that shown and described in the aforesaid Schmidt et al patent, U.S. Pat. No. 4,985,987, a feed chute 24 (see FIG. IB), which includes a substantially vertical rail and a pair of covers secured to the substantially vertical rail, extends between the hopper 22 and a guide channel 27 to transport each of the rings 12 (see FIG. 3) from the hopper 22 (see FIG. 1B) to the guide channel 27.

The feed chute 24 has a curved lower rail mount 28 (see FIG. 2) attached to the bottom end of the substantially vertical rail by screws with the covers having their bottom ends similarly connected to the curved lower rail mount 28. This arrangement enables transport of the rings 12 (see FIG. 3) from the substantially vertical rail of the feed chute 24 (see FIG. 1B) to the guide channel 27. The upper end of the substantially vertical rail of the feed chute 24 communicates with the interior of the hopper 22 through an upper feedout 30, which has the upper ends of the substantially vertical rail and the covers of the feed chute 24 secured thereto, having a curved groove 31 in one face to transport each of the rings 12 (see FIG. 3) from the hopper 22 (see FIG. IB) to the space between the substantially vertical rail and the covers of the feed chute 24.

The guide channel 27, which is particularly shown and described in the aforesaid Schmidt et al patent, U.S. Pat. No. 3,750,925, aligns the prongs 16 (see FIG. 3) of the ring 12 in the correct orientation as each of the rings 12 is advanced through the guide channel 27 (see FIG. IB) by a feed in finger or slide bar 32. The feed in finger 32 is reciprocated once during each cycle of operation of the attaching apparatus 10.

The hopper 23 (see FIG. 1A) has the sockets 11 (see FIG. 3) therein. An upper feed chute 33 (see FIG. 4) has its upper end supported by the hopper 23 for communication with the interior of the hopper 23. The upper feed chute 33 includes a rail 34 and a cover 35 attached to the rail 34 by screws. The upper end of the upper feed chute 33 receives each of the sockets 11 (see FIG. 3) from the interior of the hopper 23 (see FIG. 4).

Each of the sockets 11 (see FIG. 3) advances from the bottom end of the upper feed chute 33 (see FIG. 4) into a curved lower feed chute 38 (see FIG. 2). The curved lower feed chute 38 includes a curved feed in rail having covers attached to its back and one of its sides to retain the socket 11 (see FIG. 3) within a groove in the rail. When the socket 11 exits from the curved lower feed chute 38 (see FIG. 2) to change from a vertical disposition when it entered the curved lower feed chute 38 to a horizontal position, the socket 11 (see FIG. 3) enters a horizontally disposed guide channel 43 (see FIG. 13) to orient the socket 11 (see FIG. 12) horizontally with the annular recess 15 in the socket 11 facing downwardly.

Figure 6:
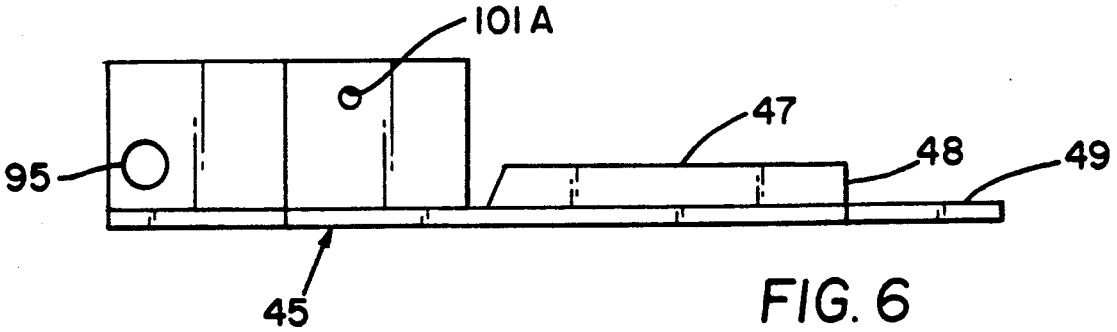
FIG. 6 is a side elevational view of a feed in finger.

A feed in finger or slide bar 45 (see FIG. 13) reciprocates in the guide channel 43 between a position in which the lowermost of the sockets 11 (see FIG. 3) in the lower curved feed chute 38 (see FIG. 13) can enter the guide channel 43 to a position in which the socket 11 (see FIG. 3) is advanced in the guide channel 43 (see FIG. 13) to a setting station 46 (see FIG. 1B). The advancement of the feed in finger 45 (see FIG. 6) disposes a substantially horizontal portion 47 of the feed in finger 45 to block the exit of the curved lower feed chute 38 (see FIG. 2) to prevent another of the sockets 11 (see FIG. 3) in the lower curved feed chute 38 (see FIG. 13) from entering the guide channel 43. The feed in finger 45 (see FIG. 6) includes a vertical surface 48 to engage the socket 11 (see FIG. 3), which rests on a horizontal surface 49 (see FIG. 6) of the feed in finger 45, to advance the socket 11 (see FIG. 3) from the guide channel 43 (see FIG. 13). The feed in finger 45 is reciprocated once during each cycle of operation of the attaching apparatus 10 (see FIG. 1B).

During each cycle of operation of the attaching apparatus 10, there is pivotal motion of a lower power arm 50, which is pivotally mounted on a shoulder shaft 51 supported by the support 20. An E-ring (not shown) retains the lower power arm 50 on the shoulder shaft 51 through fitting in a groove in the end of the shoulder shaft 51.

During each cycle of operation, there also is pivotal movement of an upper power arm 55, which is pivotally mounted on a shoulder shaft 56 supported by the support 20. A cap 57, which is secured to the end of the shoulder shaft 56 by a screw 58 extending into a threaded hole in the end of the shoulder shaft 56, retains the upper power arm 55 on the shoulder shaft 56.

The upper power arm 55 is connected to an upper end bearing 59 (see FIG. 1A) of a push rod assembly 60. The push rod assembly 60 includes a retainer 60A having an upper threaded stud 60B threaded into a threaded hole (not shown) in the bottom of the upper end bearing 59. A nut 60C is retained in a desired position on the upper threaded stud 60B by a lock nut 60D to adjustably position the retainer 60A on the upper end bearing 59.

The lower end of the retainer 60A receives the upper end of a shaft 60E, which extends through a cap 60F. The cap 60F is threaded into a threaded hole (not shown) in the bottom end of the retainer 60A. The shaft 60E has a key (not shown) in a keyway (not shown) for cooperation with a slot (not shown) in the cap 60F to prevent rotation of the shaft 60E.

A spring 60J surrounds the lower portion of the shaft 60E and has one end acting against the bottom end of the cap 60F. Two jam nuts 60K and 60L are threaded on the threaded bottom portion of the shaft 60E and the top jam nut 60K has the bottom end of the spring 60J acting thereagainst. A lock washer 60M holds the bottom jam nut 60L in position.

The shaft 60E has its threaded bottom portion received in a threaded hole (not shown) of a base 61. The push rod assembly 60 is connected to a cam 62 through having the base 61 attached to the cam 62 by a stud 63 extending through the base 61 and having its threaded end threaded into a threaded hole (not shown) in the cam 62.

Figure 7:
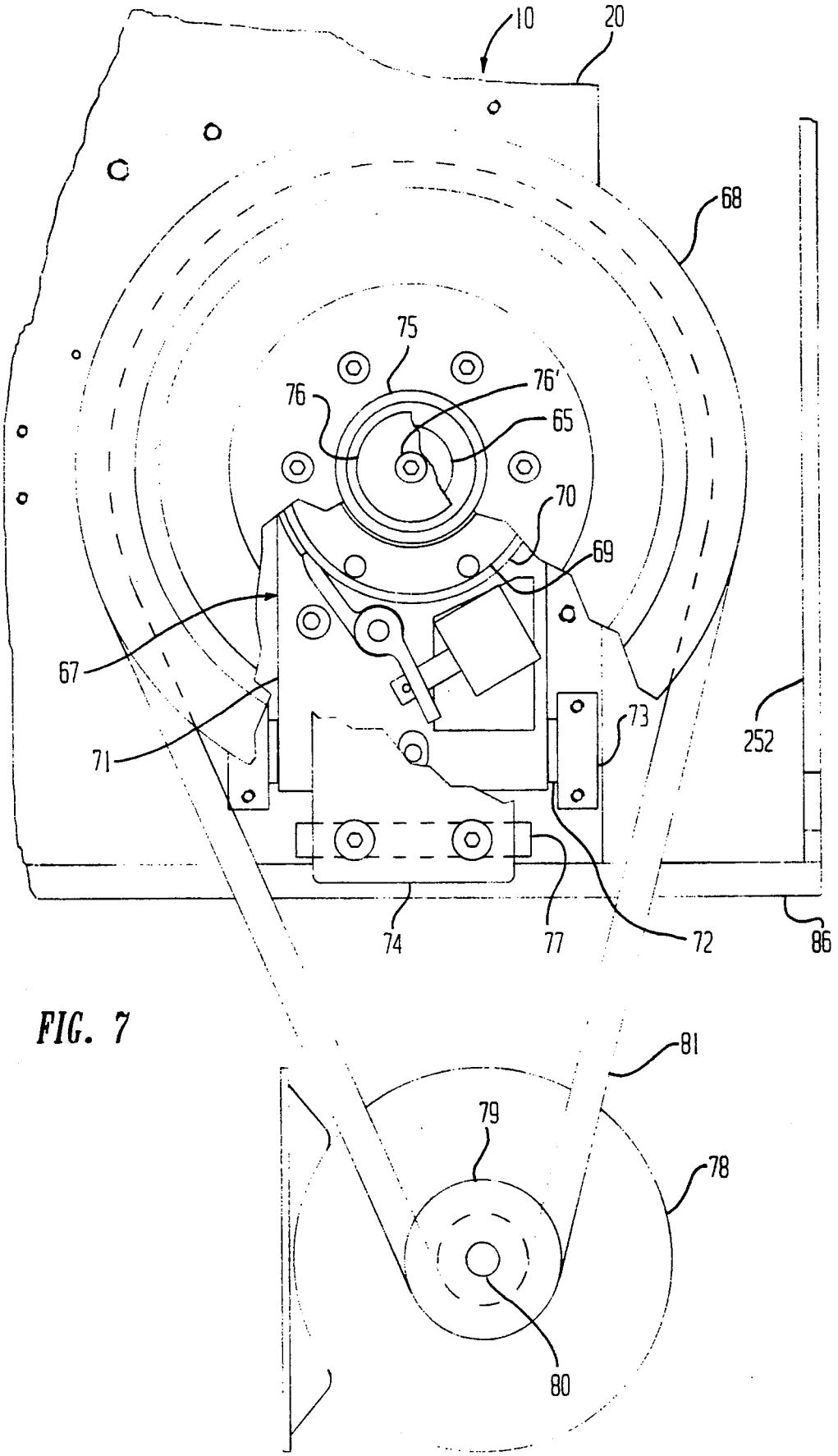
FIG. 7 is a fragmentary elevational view of a driving arrangement for rotating a cam during each cycle of operation of the apparatus.

The cam 62 is fixed to one end of a shaft 65 (see FIG. 7), which makes one revolution during each cycle of operation of the attaching apparatus 10. The shaft 65 is rotatably supported on the support 20 through a bearing (not shown).

The shaft 65 is rotated when a one revolution clutch such as a one revolution solenoid clutch 67 is activated, for example, to connect the shaft 65 to a continuously rotating flywheel 68. The flywheel 68 is secured to a flange 69 on one end of a cylindrical portion 70 of the clutch 67 extending from a plate 71 of the clutch 67.

The clutch 67 has a cylindrical portion (not shown) disposed within a hole (not shown) in the support 20 with the cylindrical portion receiving the shaft bearing. The clutch 67 is prevented from rotating by the plate 71 being disposed between two rubber bumpers 72, which are retained within metal retainers 73 secured to the support 20.

The shaft 65 is rotatably supported in a holder 74 by a bearing 75. A cap 76 is secured to the end of the shaft 65 by a screw 76' extending through a hole in the cap 76 into a threaded hole in the end of the shaft 65. The cap 76 holds the cam 62 (see FIG. 1A) in the desired position. The holder 74 (see FIG. 7) is attached to a mount 77, which is mounted on the support 20.

The flywheel 68 is continuously rotated by a continuously rotating electric motor 78. The motor 78 has a pulley 79 mounted on its shaft 80. A belt 81 connects the pulley 76 and the flywheel 68.

The motor 78 is supported on a plate (not shown). The plate has an attached block (not shown) at its upper end supported on the bottom of a support plate (not shown) at the top of a vertical standard (not shown), which is supported by a base pedestal (not shown) through an adjustable sleeve (not shown). The support plate is attached to a base plate 86, which is secured to the support 20 and has the support 20 extending upwardly therefrom.

A spring 87 (see FIG. 1B) continuously urges the lower power arm 50 clockwise about the shoulder shaft 51 to maintain a cam follower 88 (see FIG. IA) on the lower power arm 50 in continuous engagement with the cam 62. Therefore, the movement of the lower power arm 50 is controlled by the contour of the cam 62 during rotation of the cam 62.

Each of the feed in fingers 32 (see FIG. 1B) and 45 is reciprocated by motion of the upper power arm 55. The upper power arm 55 includes a downwardly extending portion 89 having its lower end pivotally connected to one end of a rod 90 through a rod end bearing 91A and a screw 91B. The rod 90 has its other end connected through a block 91 to a feed arm 92.

The feed arm 92 has its lower end pivotally connected by a screw 93 to one end of the feed in finger 32. A spring 94 extends from a hole 94A in an ear 94B of the feed arm 92 to a hole 94C in the feed in finger 32. The spring 94 continuously urges the feed in finger 32 upwardly counterclockwise about the pivot screw 93 during its reciprocation so that the feed in finger 32 is always positioned to engage the ring 12 (see FIG. 3).

The feed in finger 45 (see FIG. 1B) is pivotally connected by a pivot pin 95 to the lower end of a lever 96. The lever 96 has its upper end pivotally mounted on the support 20 by a pivot pin 97 extending from the support 20 through a bushing 98 in a cylindrical bearing 99 of the lever 96. An E-ring (not shown) is disposed in a groove (not shown) in the pivot pin 97 to connect the lever 96, which is connected to the feed arm 92 by a spring 100, to the pivot pin 97.

A spring 101 has its lower end disposed in a hole 101A in the feed in finger 45 and its upper end connected to a stud 101B in the support 20. The spring 101 continuously urges the feed in finger 45 upwardly so that the substantially horizontal portion 47 (see FIG. 6) is always held against the top of the guide channel 43 (see FIG. 13).

When the feed in finger 45 (see FIG. 1B) is advanced, the socket 11 (see FIG. 3) is advanced by the feed in finger 45 (see FIG. 1B) between two side plates 102 (see FIG. 2) and 103, which are mounted on a plunger 104 having a die 105 retained in its bottom end by a set screw 105,. The side plates 102 and 103 are mounted on the plunger 104 through a bolt 106 passing through the side plate 102, an elongated slot (not shown) in the plunger 104, and the side plate 103. The bolt 106 cooperates with a nut 107 to retain the side plates 102 and 103 on the plunger 104.

A spring 108 is disposed on the bolt 106 between the head of the bolt 106 and the side plate 102, and a spring 109 is disposed on the bolt 106 between the side plate 103 and the nut 107. The springs 108 and 109 enable the side plates 102 and 103 to separate slightly from each other to cease to hold the socket 11 (see FIG. 3) when the socket 11 and the ring 12 are attached to each other and to the material 14.

The upper power arm 55 (see FIG. 1B) has a pair of brackets (one shown at 110) on opposite sides thereof and attached thereto adjacent one end thereof. A block 112 is retained between the two brackets 110 beneath the upper power arm 55.

A rod 113, which has its upper and lower ends threaded, has its upper end threaded into a threaded hole (not shown) in the lower end of the block 112. The rod 113 has its lower end extend through a passage (not shown) in a swivel 114.

An L-shaped bracket 115, which is attached to the lever 96, has a cylindrical pivot portion 116 of the swivel 114 pass through an opening (not shown) in the bracket 115 and retained therein by an E-ring (not shown) being disposed in a groove (not shown) in the cylindrical pivot portion 116. A sleeve 119 extends upwardly from the bottom of the swivel 114 through the passage in the swivel 114 to have the rod 113 pass therethrough. The sleeve 119 has its head 119A hold a washer 119B against the bottom of the swivel 114.

The rod 113 extends through an overtravel spring 120 beneath the swivel 114 to enable a nut 121 to be attached to the bottom threaded end of the rod 113. Thus, motion of the upper power arm 55 is transmitted to the lever 96 through the rod 113, the swivel 114, and the bracket 115 whereby the feed in finger 45 is reciprocated through pivoting of the lever 96 about the axis of the pivot pin 97.

As previously mentioned, the downwardly extending portion 89 of the upper power arm 55 is connected to the feed arm 92 for causing reciprocation of the feed in finger 32. Pivoting of the upper power arm 55 causes pivoting of the feed arm 92 to reciprocate the feed in finger 32. Accordingly, each of the feed in fingers 32 and 45 is reciprocated in each direction once during each cycle of operation of the attaching apparatus 10 because of pivotal movement of the upper power arm 55.

The feed in finger 32 is moved inwardly during the first half of each cycle of operation and outwardly during the second half of each cycle of operation. The feed in finger 45 is moved inwardly at the end of each cycle of operation and outwardly at the start of each cycle of operation.

The upper power arm 55 also is connected to a ram 122 for causing axial motion of the ram 122, which is slidably disposed within a housing 122A supported by the support 20 and having a cover 122B attached thereto, in both directions. This connection includes a pivot block 123 (see FIG. 2) having pivot pins 124 and 125 extending from opposite sides thereof for disposition in openings 126 and 127 in the two brackets 110 (one shown in FIG. 1B), on the upper power arm 55 to pivotally support the pivot block 123 on the upper power arm 55.

The pivot block 123 (see FIG. 2) supports a clevis 128 through the clevis 128 having a threaded rod 129 on its upper end extending through a passage (not shown) in the pivot block 123. An overtravel spring 131 surrounds the threaded rod 129 between a cap nut 132 on the end of the threaded rod 129 and the pivot block 123. Thus, the clevis 128 is resiliently connected to the pivot block 123. The clevis 128 is connected to the ram 122 through the ram 122 having its reduced upper end 133 connected by a shaft 134 to the clevis 128.

The ram 122 has an elongated recess 135 extending inwardly from its bottom end to receive the plunger 104. The plunger 104 is connected to the ram 122 by two set screws 135A engaging two flats (not shown) on the plunger 104.

The plunger 104 has a spring 136 disposed therein with one end of the spring 136 engaging a screw 137 at the upper end of the plunger 104. The other end of the spring 136 engages a head 138 of a pin 139, which engages the bolt 106. Therefore, downward movement of the ram 122 by the upper power arm 55 (see FIG. 1B) causes the die 105 (see FIG. 2) to be moved downwardly.

The ring 12 (see FIG. 3) is held in position by a pair of pivotally mounted jaws 140 (see FIG. 2) and 141. Prior to downward movement of the die 105 to exert a force on the socket 11 (see FIG. 3) to connect the socket 11 to the ring 12, the ring 12 is moved upwardly out of gripping engagement by the jaws 140 (see FIG. 2) and 141 through upward movement of a holder 142. The holder 142 is moved upwardly by pivotal movement of the lower power arm 50 during each cycle of operation of the attaching apparatus 10.

Each of the jaws 140 and 141 is pivotally mounted on an anvil block 143 by a screw 144. Springs 145 and 146, which are mounted on the anvil block 143, continuously urge the jaws 140 and 141, respectively, towards each other.

The anvil block 143 is supported on the support 20 (see FIG. 1B). A rail 147, which has the guide channel 27 along which the ring 12 (see FIG. 3) is moved by the feed in finger 32 (see FIG. 1B), is supported by the anvil block 143 through a cover 148. The rail 147 has a rail 149, which is supported by the anvil block 143 through a cover 149' (see FIG. 2), for cooperation therewith to define a passage therebetween through which the ring 12 (see FIG. 3) is advanced along the guide channel 27 (see FIG. IB) by the feed in finger 32.

A spring 150 (see FIG. 2) surrounds the holder 142 and continuously urges it into engagement with an extending screw 151 on the lower power arm 50 at its remote end from the cam follower 88 (see FIG. 1A). The screw 151 (see FIG. 1B) lifts the holder 142 during pivotal motion of the lower power arm 50 in each cycle of operation of the attaching apparatus 10. As previously mentioned, pivotal motion of the lower power arm 50 is due to the cam follower 88 (see FIG. 1A) engaging the contour of the cam 62.

When the ram 122 (see FIG. 2) and the attached plunger 104 are moved downwardly, the side plates 102 and 103 engage the material 14 to hold the material 14 against upper surfaces 152 and 153 of the covers 148 and 149', respectively, as more particularly shown and described in the aforesaid Schmidt et al patents. As the holder 142 is moved upwardly against the force of the spring 150, a top surface 154 of the holder 142 receives the ring 12 (see FIG. 3) and the jaws 140 (see FIG. 2) and 141 are cammed out of engagement with the ring 12 (see FIG. 3) by the upward movement of the holder 142 (see FIG. 2).

The holder 142 has the top surface 154 formed with a recess 154A having the configuration of the bottom annular portion of the ring 12 (see FIG. 3) with the prongs 16 extending upwardly. Thus, the recess 154A (see FIG. 2), which surrounds a hole 154B in the top surface 154, receives the bottom portion of the ring 12 (see FIG. 3) to support the ring 12 when the ring 12 is no longer gripped by the jaws 140 (see FIG. 2) and 141.

As the holder 142 is moved upwardly, the prongs 16 (see FIG. 3) on the ring 12 enter the annular recess 15 (see FIG. 12) in the socket 11 after passing through the material 14 (see FIG. 3). Each of the side plates 102 (see FIG. 2) and 103 has a surface 155 and 156, respectively, to receive an arcuate part of the bottom annular portion of the socket 11 (see FIG. 3).

As the ram 122 (see FIG. 2) and the plunger 104 are moved downwardly, the guide plates 102 and 103 are prevented from further movement because of engagement with the upper surfaces 152 and 153 of the covers 148 and 149', respectively. However, the ram 122 (see FIG. 2) and the plunger 104 can continue to move because the side plates 102 and 103 are resiliently connected to the plunger 104. The resilient connection includes the spring 136.

As the plunger 104 moves downwardly relative to the side plates 102 and 103 while the holder 142 is moving upwardly, the die 105 engages the socket 11 (see FIG. 3) to cause deformation of the prongs 16 on the ring 12 within the annular recess 15 (see FIG. 12) in the socket 11. The springs 108 (see FIG. 2) and 109 enable the side plates 102 and 103 to separate slightly from each other to cease to hold the socket 11 (see FIG. 3). This occurs after the die 105 (see FIG. 2) has engaged the socket 11 (see FIG. 3) to cause deformation of the prongs 16 of the ring 12 within the annular recess 15 (see FIG. 12) in the socket 11.

The hopper 22 (see FIG. 1B) includes a front wall 157, substantially parallel side walls 158 and 159, a rear wall 160, and an inclined bottom wall 161. A divider 162, which is attached to a portion 163 of the front wall 157 and a portion 164 of the rear wall 160, divides the hopper 22 into a supply compartment and a reserve compartment. The divider 162 has a lower bent portion 167, which engages the bottom wall 161 but does not extend the entire width of the divider 162. Thus, a portion of the divider 162 is spaced from the bottom wall 161 to provide an opening 167' between the supply compartment and the reserve compartment so that the rings 12 (see FIG. 3) within the reserve compartment can flow by gravity into the supply compartment when the supply compartment needs replenishment.

Figure 10:
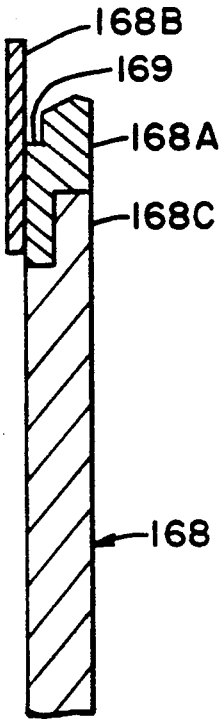
FIG. 10 is a fragmentary sectional view of a portion of the knife blade used with one of the hoppers.

The supply compartment has a pivotally mounted knife blade 168 (see FIG. 1B) adjacent the side wall 159 of the hopper 22. A blade strip 168A (see FIG. 10), which has a strip 168B connected thereto, is connected to a reduced portion 168C of the knife blade 168.

The blade strip 168A has a slot constituting an upper edge surface 169 on which some of the rings 12 (see FIG. 3) are disposed when the knife blade 168 (see FIG. 10) is pivoted upwardly within the hopper 22 (see FIG. IB). When the knife blade 168 reaches its uppermost position during pivoting, the upper edge surface 169 (see FIG. 10) is in alignment with the upper feedout 30 (see FIG. 1B) through an opening 170 in the rear wall 160 of the hopper 22 to enable one or more of the rings 12 (see FIG. 3) to flow by gravity into the groove 31 (see FIG. 1B) in the upper feedout 30 of the feed chute 24 and then into the space between the rail and the covers of the feed chute 24.

Figure 14:
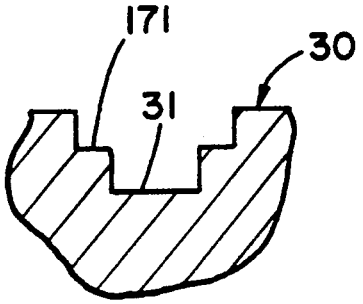
FIG. 14 is a fragmentary sectional view of a portion of an upper feed out.

As shown in FIG. 14, the upper feedout 30 has a flat surface 171 on each side of the groove 31 above the bottom of the groove 31. The prongs 16 (see FIG. 3) on the ring 12 extend into the groove 31 (see FIG. 14) while arcuate parts of the annular portion of the ring 12 (see FIG. 3) ride on the flat surfaces 171 (see FIG. 14). A cover 172 (see FIG. 1B) is attached to the upper feedout 30 to form a closed passage for the rings 12 (see FIG. 3) to insure that each of the rings 12 is properly oriented when it leaves the hopper 22 (see FIG. 1B).

Figure 9:
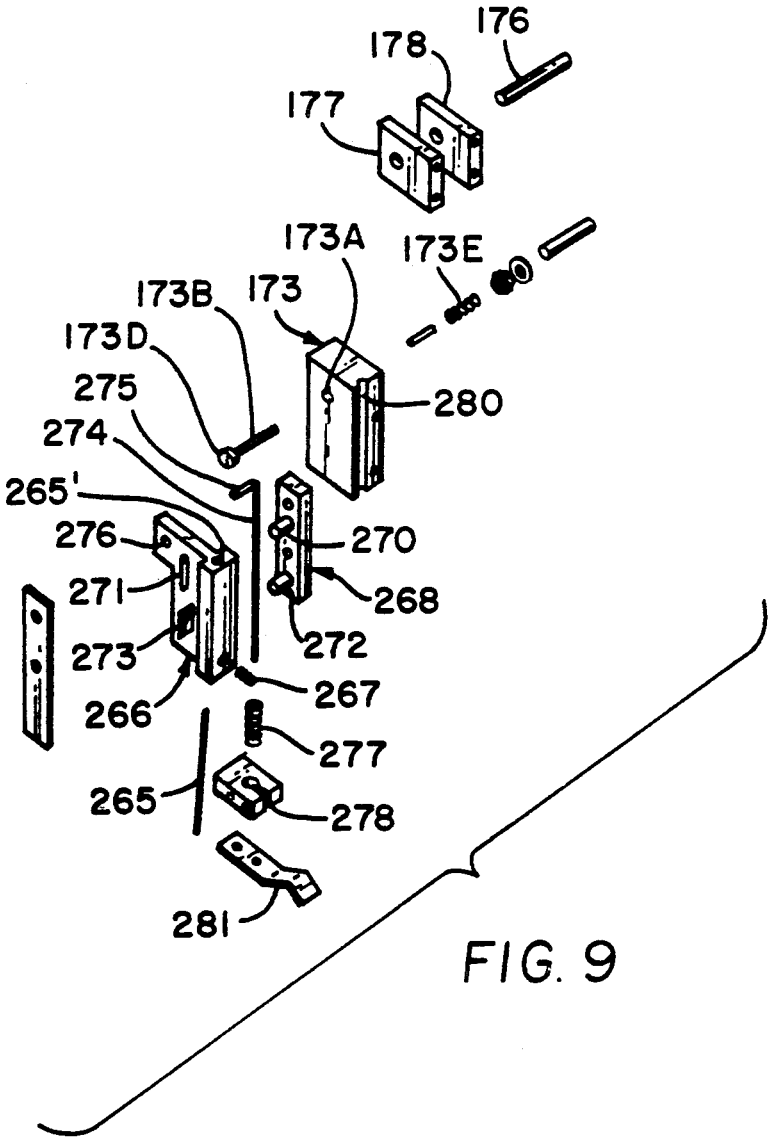
FIG. 9 is an exploded perspective view of an arrangement for preventing a fastener element from blocking an exit from one of the hoppers.

The feed chute 24 has its upper end releasably connected to the rear wall 160 of the hopper 22 through a block 173, which is attached to the outer surface of the rear wall 160. The block 173 has an opening 173A (see FIG. 9) to receive a screw 173B extending therethrough. The screw 173B fits within a slot (not shown) in the upper feedout 30 (see FIG. IB) when the feed chute 24 is to be connected to the rear wall 160 of the hopper 22 for support thereby. The screw 173B (see FIG. 9) has its head 173D biased into engagement with the block 173 by a spring 173E.

The knife blade 168 (see FIG. 1B) is secured to an arm 175, which is exterior of the hopper 22. The arm 175 is secured to a shaft 176, which has its ends rotatably supported in two spaced mounting ears 177 and 178 attached to the exterior of the rear wall 160. Thus, rotation of the shaft 176 causes pivoting of the knife blade 168.

The knife blade 168 is driven from an electric motor 180 (see FIG. IA). The motor 180 is supported by a mounting plate 181, which is supported on the support 20. A motor pulley 182 is mounted on an output shaft 183 of a gear box (not shown) having its input gear driven by a shaft of the motor 180.

A belt 184 connects the motor pulley 182 to a cam pulley 185. The cam pulley 185 is rotatably supported on a cam shaft 186 by a bearing (not shown). The cam shaft 186 is mounted on a mounting plate 188, which is carried by the support 20.

A cam 189 is rotatably supported on the cam shaft 186 by a bearing 190. An E-ring (not shown) retains the cam pulley 185 and the cam 189 on the cam shaft 186 through being disposed in a groove in the end of the shaft 186.

The cam pulley 185 and the cam 189 are secured to each other so that rotation of the cam pulley 185 is transmitted to the cam 189. Accordingly, when the cam pulley 185 is driven by the motor 180 through the belt 184, the cam 189 rotates.

A cam follower 192 is rotatably mounted on a cam follower arm 193 intermediate the ends of the cam follower arm 193. The cam follower arm 193 is rotatably mounted on a shaft 194, which is supported on the mounting plate 188, through a bushing 195.

The cam follower arm 193 is connected through a rod end bearing 196 to a link 197, which is connected to an upper rod end bearing 198 (see FIG. 1B). The link 197 has a spring clamp 199 (see FIG. IA) mounted thereon with one end of a spring 200 connected thereto. The spring 200 has its other end connected to a mounting plate 201, which is supported by the mounting plate 188.

The upper rod end bearing 198 (see FIG. 1B) is connected to a triangular shaped block 202, which is clamped to a shaft 203. The shaft 203 is rotatably supported in a pair of substantially parallel ears 204 and 205 secured to a rear wall 206 of the hopper 23. The block 202 is disposed between the ears 204 and 205.

The block 202 is connected to an upper rod end bearing 207 on an upper end of a link 208. The link 208 has a lower rod end bearing 209, which is connected to a block 210. The block 210 is secured to the shaft 176 for rotation therewith.

Accordingly, when the motor 180 (see FIG. 1A) causes the block 202 (see FIG. 1B) to pivot about the axis of the shaft 203 through movement of the link 197, each of the shafts 176 and 203 is rotated. Rotation of the shaft 176 causes pivotal movement of the knife blade 168 due to the arm 175, which is secured to the knife blade 168, being moved by rotation of the shaft 176.

The hopper 23 (see FIG. 4) includes a front wall 220, substantially parallel side walls 221 (see FIG. IA) and 222 (see FIG. 4), and a bottom wall 223 in addition to the rear wall 206. A divider 224, which is attached to the rear wall 206 and the front wall 220, divides the hopper 23 into a supply compartment and a reserve compartment. The divider 224 has its bottom edge spaced from the bottom wall 223 so that the sockets 11 (see FIG. 3) within the reserve compartment can flow into the supply compartment by gravity when the supply compartment needs replenishment.

Figure 11:
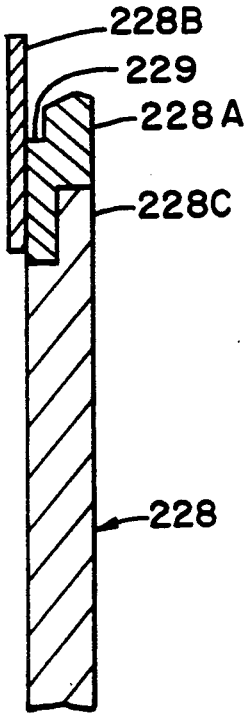
FIG. 11 is a fragmentary sectional view of a portion of the knife blade used with the other of the hoppers.

The supply compartment has a pivotally mounted knife blade 228 adjacent the side wall 222 of the hopper 23. A blade strip 228A (see FIG. 11), which has a side strip 228B secured thereto, is secured to a reduced portion 228C of the knife blade 228.

The blade strip 228A has a slot constituting an upper edge surface 229 on which some of the sockets 11 (see FIG. 3) are disposed when the knife blade 228 (see FIG. 4) is pivoted upwardly within the hopper 23. When the knife blade 228 reaches its uppermost position during pivoting, the upper edge surface 229 (see FIG. 11) is in alignment with the upper feed chute 33 (see FIG. 4) at the rear wall 206 of the hopper 23 to enable one or more of the sockets 11 (see FIG. 3) to flow by gravity into the upper feed chute 33 (see FIG. 4).

The upper ends of the rail 34 and the cover 35 of the upper feed chute 33 are supported by the rear wall 206 of the hopper 23 through a block 230, which is attached to the outer surface of the rear wall 206. The block 230 has an upper mount 231 (see FIG. 5), which is secured to the upper feed chute 33 and a spacer 232 by screws, releasably connected thereto by a screw 233.

The screw 233 fits within a slot 234 in the upper mount 231 when the upper feed chute 33 is to be supported by the rear wall 206 (see FIG. 4) of the hopper 23. The screw 233 (see FIG. 5) has its head 234' biased into engagement with the upper mount 231 by a spring (not shown).

The screw 233 extends through a passage (not shown) in the block 230, a hollow tubular stop (not shown), and the spring to receive a nut (not shown). A knob (not shown) is attached to the threaded end of the screw 233 to enable movement of the screw 233 in a direction along its longitudinal axis against the force of the spring to connect and disconnect the upper feed chute 33.

The knife blade 228 (see FIG. 4) is secured to an arm 235, which is exterior of the hopper 23. The arm 235 is secured to the shaft 203. Thus, rotation of the shaft 203 by the motor 180 (see FIG. 1A) causes pivoting of the knife blade 228 (see FIG. 4).

The knife blades 168 (see FIG. 1B) and 228 (see FIG. 4) are actuated through the link 197 (see FIG. 1B) so that one of the knife blades 168 and 228 (see FIG. 4) is moved upwardly while the other of the knife blades 168 (see FIG. IB) and 228 (see FIG. 4) is moved downwardly. To prevent a build up of the rings 12 (see FIG. 3) within the hopper 22 (see FIG. 1B) adjacent the upper feedout 30 when the knife blade 168 is moved upwardly to dispose some of the rings 12 (see FIG. 3) on the upper edge surface 169 (see FIG. 11) of the knife blade 168, a rod 240 (see FIG. 1B) is reciprocated from the motor 180 (see FIG. 1A) to advance the rod 240 (see FIG. 1B) into the hopper 22 when the knife blade 168 is moved downwardly and to retract the rod 240 when the knife blade 168 is moved upwardly.

The rod 240 (see FIG. IA) is connected through a coupling 241 to a plunger 242, which extends through a hollow retainer 243 disposed within a cylindrical housing 244. The retainer 243 has a threaded end for attaching to a threaded inner surface of a stepped recess 245 (see FIG. 8) in the housing 244. The stepped recess 245 in the housing 244 has the plunger 242 slidable thereinto. One end of the plunger 242 has a flange 246 against which one end of a spring 247, which is within the stepped recess 245 in the housing 244, bears. The other end of the spring 247 engages a bottom end 248 of the stepped recess 245 in the housing 244.

The housing 244 (see FIG. 1A) is pivotally mounted on the upper end of a lever 249. The lever 249 has a stud 250 pivotally mounted in a mounting block 251, which is supported on a plate 252 extending upwardly from the base plate 86.

An arm 253 on the lever 249 is held against a roller 254, which is disposed on the cam 189 at a predetermined position, by a spring 255. The spring 255 has one end connected to the plate 252 by an eye 256 and its other end connected to a stud 257 on a collet 258. The collet 258 is retained on the retainer 242 intermediate its ends by a set screw 259.

Accordingly, as the cam 189 is rotated during each cycle of operation of the motor 180, the lever 249 is pivoted clockwise to advance the rod 240 into the interior of the hopper 22 (see FIG. 1B) for a predetermined distance when the knife blade 168 moves to its lowermost position. The rod 240 prevents any build up of the rings 12 (see FIG. 3) within the hopper 22 (see FIG. 1B) adjacent the upper feedout 30 so that the rings 12 (see FIG. 3) within the hopper 22 (see FIG. 1B) can enter the upper feedout 30 from the upper edge surface 169 (see FIG. 10) of the knife blade 168.

To prevent a build up of the sockets 11 (see FIG. 3) in the hopper 23 (see FIG. 4) adjacent the upper feed chute 33, a rod 260 is reciprocated by the motor 180 (see FIG. 1A) so that the rod 260 (see FIG. 4) advances into the interior of the hopper 23 through a passage in the block 230 and a passage in the rear wall 206 of the hopper 23 when the knife blade 228 is moved downwardly. The rod 260 is retracted from the interior of the hopper 23 when the knife blade 228 moves upwardly.

The rod 260 is connected to an arm 261, which is secured to the shaft 176. Therefore, the rod 260 is advanced into the hopper 23 when the knife blade 22 is moved downwardly by the motor 180 (see FIG. 1A).

After the knife blade 168 (see FIG. 1B) has moved upwardly in the hopper 22 to dispose one of the rings 12 (see FIG. 3) in the upper feedout 30 (see FIG. 1B), the ring 12 (see FIG. 3) may not enter the upper feedout 30 (see FIG. 1B) because of the orientation of the ring 12 (see FIG. 3) within the upper feedout 30 (see FIG. IB). Accordingly, the hopper 22 has a finger 265 that is activated when the knife blade 168 is moved downwardly within the hopper 22 at the start of each cycle of motion of the knife blade 168. This activation of the finger 265 removes one of the rings 12 (see FIG. 3) when it is blocking the upper feedout 30 (see FIG. 1B) because the ring 12 (see FIG. 3) is not correctly oriented to enter the upper feedout 30 (see FIG. 1B). This incorrect orientation occurred during the prior cycle of pivoting of the knife blade 168.

The finger 265 is retained within a passage 265' (see FIG. 9) in a block 266 by a set screw 267. This enables the finger 265 to have its position adjusted to insure that one of the rings 12 (see FIG. 3) will be removed by the finger 265 (see FIG. 1B) if the ring 12 (see FIG. 3) is blocking the upper feedout 30 (see FIG. 1B).

The block 266 (see FIG. 9) is slidably and pivotally supported on a spacer 268, which is mounted on a portion of the rear wall 160 (see FIG. IB) of the hopper 22. The spacer 268 (see FIG. 9) has an upper pin 270 extending therefrom into a longitudinal slot 271 in the block 266 to guide the motion of the block 266. The spacer 268 has a lower pin 272, which extends for a greater distance than the upper pin 270, extending into an enlarged opening 273 in the block 266.

An L-shaped rod 274 of circular cross section has an end 275 disposed in a circular opening 276 in the block 266. The rod 274 extends through a spring 277 into a follower 278 to which the rod 274 is clamped. The spring 277 has its lower end bearing against the upper surface of the follower 278 while the spring 277 has its upper end bearing against a lower end of the block 173, which is secured to the outer surface of the rear wall 160 (see FIG. 1B) of the hopper 22. The block 173 (see FIG. 9) has a vertical slot 280 in one edge to receive a vertical portion of the rod 274 to enable it to slide therein.

When the knife blade 168 (see FIG. 1B) is initially moved upwardly within the hopper 22, a spring arm 281, which is secured to the top of the pivotally mounted arm 175, engages the bottom of the follower 278 to move the rod 274 upwardly whereby the block 266 is pivoted clockwise about the end 275 of the rod 274 and also raised with the rod 274. This initial motion of the finger 265 lifts and pivots the finger 265 upwardly so that the finger 265 does not prevent one of the rings 12 (see FIG. 3) from entering the upper feedout 30 (see FIG. 1B) when the knife blade 168 reaches its uppermost position in which one or more of the rings 12 (see FIG. 3) can enter the upper feedout 30 (see FIG. 1B) from the hopper 22. The clockwise pivoting and lifting of the block 266 removes the finger 265 from the position in which it blocks communication of the upper feedout 30 with the interior of the hopper 22 before the knife blade 168 reaches its uppermost position in which it feeds the rings 12 (see FIG. 3) to the upper feedout 30 (see FIG. 1B) from the hopper 22.

When the knife blade 168 pivots downwardly, the spring 277 (see FIG. 9) holds the follower 278 (see FIG. 1B) against the spring arm 281 so that the rod 274 moves downwardly to pivot the block 266 counterclockwise and pull the block 266 downwardly. Counterclockwise pivoting of the block 266 after downward movement of the block 266 moves the finger 265 to remove one of the rings 12 (see FIG. 3) when the ring 12 is blocking communication of the upper feedout 30 (see FIG. IB) with the interior of the hopper 22. This would occur when the prongs 16 (see FIG. 3) on the ring 12 are facing in the wrong direction to prevent the ring 12 from entering the upper feedout 30 (see FIG. 1B) since the prongs 16 (see FIG. 3) cannot enter the groove 31 (see FIG. 14).

The hopper 23 (see FIG. 1A) has a finger 285 (see FIG. 5) for engaging one of the sockets 11 when the socket 11 is oriented so that it cannot enter the upper feed chute 33 from the interior of the hopper 23 (see FIG. 4) whereby the incorrectly oriented socket 11 (see FIG. 3) blocks entry to the upper feed chute 33 (see FIG. 4). The finger 285 (see FIG. 5) is slidably mounted in a mounting block 286, which is secured to a feedout block 287 having a groove 288 through which each of the sockets 11 moves from the interior of the hopper 23 (see FIG. 4) to the upper feed chute 33. The finger 285 (see FIG. 5) extends into a groove 289, which is substantially perpendicular to the groove 288, in the block 287 to engage the socket 11 when the socket 11 cannot be advanced through the groove 288 (see FIG. 5) in the feed block 287 because the socket 11 is not correctly oriented.

The finger 285 has its lower end extending through a spring 290, which is retained within a passage 291 in the block 286 by a plate 292. The plate 292 is secured to the bottom of the block 286.

The passage 291 has its upper end smaller than the remainder of the passage 291 and the spring 290 so that only the finger 285 can extend upwardly through the upper end of the passage 291 in the block 286. The finger 285 has a stop 293, which is within the passage 291 in the block 286, disposed beneath the bottom of the spring 290 to enable the spring 290 to continuously urge the finger 285 downwardly.

When a roller 294 on the arm 235 engages an upper surface 295 on a cam 296, the finger 285 is advanced upwardly in the groove 289 in the feedout block 287 to enter the groove 288 in the feedout block 287. This enables the finger 285 to remove one of the sockets 11 when the socket 11 is incorrectly oriented in the groove 288 so as to not pass therethrough to the upper feed chute 33.

The cam 296 is secured to a block 297, which is pivotally mounted on the block 286 by a pivot pin 298. The pivot pin 298 is fixed in a hole in the block 286 and extends through a bushing 298A in the block 297 and through a hole in a bracket 298D. The bracket 298D and the pivot pin 298 are fixed to the feedout block 287.

The block 297 has a spring finger 299 mounted on its bottom surface so that counterclockwise (as viewed in FIG. 5) pivoting of the block 297 about the pivot pin 298 by the cam surface 295 being engaged by the roller 294 on the arm 235 causes the spring finger 299, which has the bottom end of the finger 285 engaging its upper surface, to move the finger 285 upwardly against the force of the spring 290. The cam surface 295 is engaged by the roller 294 during downward motion of the knife blade 228 so that the finger 285 moves upwardly in the groove 289 in the feedout block 287 when the knife blade 228 is completing its downward motion.

Accordingly, the pivotal motion of the spring finger 299 moves the finger 285 in response to the pivotal motion of the arm 235. Thus, the finger 285 is effective to remove the socket 11 when it is incorrectly oriented in the groove 288 in the feedout block 287 so as to block the groove 288.

Figure 15:
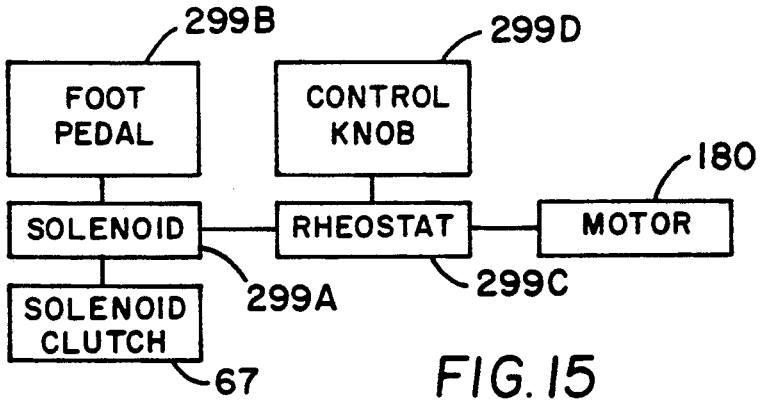
FIG. 15 is a schematic block diagram of a portion of the electrical control system for the attaching apparatus.

It should be understood that the motor 180 (see FIG. 1A) is energized each time that the clutch 67 (see FIG. 7) is energized by a solenoid clutch switch 299A (see FIG. 15) being activated, preferably by a foot pedal 299B being depressed by an operator of the attaching apparatus 10 (see FIGS. 1A and 1B), to begin a cycle of operation of the attaching apparatus 10. The motor 180 (see FIG. 15) makes at least one revolution each time that it is energized and can make a plurality of revolutions each time that it is energized. The number of revolutions of the motor 180 during each energization is determined by a rheostat 299C, which an operator adjusts through a control knob 299D, for example, to change the resistance so that the motor 180 rotates from one to a selected number of revolutions.

Considering the operation of the attaching apparatus 10 (see FIG. 1B), the feed chute 24 is substantially filled from the hopper 22 with the rings 12 (see FIG. 3) having the prongs 16. The upper feed chute 33 (see FIG. 4) and the lower feed chute 38 (see FIG. 2) are substantially filled with the sockets 11 (see FIG. 3).

The cycle of operation of the attaching apparatus 10 (see FIGS. 1A and 1B) begins with the solenoid clutch switch 299A (see FIG. 15) being closed. This closing of the solenoid clutch switch 299A energizes the one revolution solenoid clutch 67 (see FIG. 7) to connect the flywheel 68 to the cam shaft 65 to rotate the cam shaft 65 and the attached cam 62 (see FIG. 1A) through one revolution. The solenoid clutch 67 (see FIG. 7) is automatically inactivated at the end of each revolution of the cam shaft 65.

Rotation of the cam 62 (see FIG. 1A) causes the upper power arm 55 to begin to pivot. During the initial pivoting of the upper power arm 55, the feed in finger 45 (see FIG. 1B) is moved away from the setting station 46. It should be understood that the ram 122 is held at a fixed position at the end of each cycle of operation through the cap nut 132 on the upper end of the threaded rod 129 engaging a fixed stop 300 adjustably supported on a bracket 301, which is fixed to the support 20. After the feed in finger 45 is moved away from the setting station 46 at the start of a cycle of operation of the attaching apparatus 10, the ram 122 is moved downwardly by the pivotal movement of the upper power arm 55.

During the first 180° of rotation of the cam shaft 65 (see FIG. 7), the feed in finger 32 (see FIG. 1B) is withdrawn from the setting station 46. This withdrawal of the feed in finger 32 enables another of the rings 12 (see FIG. 3) to enter the guide channel 27 (see FIG. 1B) from the curved lower rail mount 28. During the second 180° of rotation of the cam shaft 65 (see FIG. 7), the feed in finger 32 (see FIG. 1B) feeds one of the rings 12 (see FIG. 3) to the setting station 46.

When the ram 122 moves down, the die 105 (see FIG. 2), which is carried by the plunger 104 attached to the ram 122, engages the socket 11 (see FIG. 3). This exerts a force on the socket 11 to move the socket 11 towards the ring 12.

After the ram 122 (see FIG. 1B) starts its downward motion, the holder 142 is lifted upwardly by pivoting of the lower power arm 50, which is under control of the cam 62 (see FIG. 1A) through the cam follower 88 on the lower power arm 50 riding along the contour of the cam 62. The upward movement of the holder 142 (see FIG. IB) moves the prongs 16 (see FIG. 3) on the ring 12 into the annular recess 15 (see FIG. 12) in the socket 11 after the prongs 16 (see FIG. 3) pass through the material 14.

Continued rotation of the cam shaft 65 (see FIG. 7) results in the lower power arm 50 (see FIG. 2) pivoting to allow the spring 150 to return the holder 142 to a position in which the jaws 140 and 141 are no longer held apart. This disposes the jaws 140 and 141 to receive another of the rings 12 (see FIG. 3) during the next cycle of operation of the attaching apparatus 10 (see FIG. IB).

During upward motion of the ram 122 by pivotal movement of the upper power arm 55, the pivotal movement of the upper power arm 55 also causes the feed in finger 45 to advance another of the sockets 11 (see FIG. 3) through the guide channel 43 (see FIG. 13) to the setting station 46 (see FIG. 1B). The feed in finger 32 also advances another of the rings 12 (see FIG. 3) through the guide channel 27 (see FIG. 1B) to the setting station 46 during upward motion of the ram 122. The cycle ends with the ram 122 being held in a fixed position through the cap nut 132 on the upper end of the threaded rod 129 engaging the fixed stop 300 on the support 20.

Whenever it is desired to empty the hopper 23 (see FIG. 1A) of the sockets 11 (see FIG. 3) therein so as to replace them with another type of fastener element, a gate (not show) is raised upwardly to uncover an opening in the front wall 220 (see FIG. 4) of the hopper 23. The gate is slidably supported on the outer surface of the front wall 220 of the hopper 23 by a pair of substantially parallel tracks (not shown), which are secured to the outer surface of the front wall 220.

When the gate is lifted upwardly, the sockets 11 (see FIG. 3) within the hopper 23 (see FIG. 4) flow therefrom through the opening in the front wall 220 of the hopper 23 into a discharge chute (not shown), which is attached to the outer surface of the front wall 220 of the hopper 23. The discharge chute has an opening in one of its a walls to allow the sockets 11 (see FIG. 3) to enter the interior of the discharge chute and flow along an inclined bottom wall by gravity.

It is not necessary for the hopper 22 (see FIG. 1B) to have any emptying arrangement, which is similar to the discharge chute of the hopper 23 (see FIG. 4). This is because the interior of the hopper 22 (see FIG. 1B) is easily accessible from the front of the attaching apparatus 10.

When the hopper 22 has the rings 12 (see FIG. 3) replaced with another type of fastener element, it may be necessary to replace the feed chute 24 (see FIG. 1B), the blade strip 168A and the strip 168B to conform to the configuration of the new type of fastener element. When the hopper 23 (see FIG. 4) has the sockets 11 (see FIG. 3) replaced with another type of fastener element, it may be necessary to replace the upper feed chute 33 (see FIG. 4), the lower curved feed chute 38 (see FIG. 2), the blade strip 228A (see FIG. 4), and the side strip 228B to conform to the configuration of the new type of fastener element.

An advantage of this invention is that it reduces the noise level produced by the apparatus in comparison with pneumatic actuators. Another advantage of this invention is that an operator can select various numbers of the fastener elements to be supplied from the hoppers during each cycle of operation of the attaching apparatus. A further advantage of this invention is that it eliminates air cylinders. Still another advantage of this invention is that more precise control of the movable portions of the attaching apparatus is obtained. A still further advantage of this invention is that fastener elements within a hopper are prevented from blocking feeding of the fastener elements from the hopper. Yet another advantage of this invention is that it avoids any movement of the material during attachment of the fastener elements thereto.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

We claim:

1. An attaching apparatus for attaching first and second mating fastener elements to material at a setting station, said apparatus comprising:

support means and ram means at the setting station;

moving means for creating movement of said support means and said ram means towards each other;

said moving means including:

a single power source for creating movement of said support means and said ram means towards each other;

a first pivotally mounted arm for causing movement of said support means when said single power source creates movement of said first pivotally mounted arm;

a second pivotally mounted arm for causing movement of said ram means when said single power source creates movement of said second pivotally mounted arm;

and activation control means for controlling activation of each of said first pivotally mounted arm and said second pivotally mounted arm during a cycle of operation of said attaching apparatus;

a first hopper having a plurality of first fastener elements therein;

a second hopper having a plurality of second fastener elements therein;

first transport means for transporting each of the first fastener elements from said first hopper to a position at the setting station in a specific orientation for engagement by one of said support means and said ram means;

second transport means for transporting each of the second fastener elements from said second hopper to a position at the setting station in a specific orientation for engagement by the other of said support means and said ram means;

and selective control means for controlling movement of each of said first pivotally mounted arm and said second pivotally mounted arm by said single power source to attach the first fastener element and the second fastener element to each other at the setting station.

2. The attaching apparatus according to claim 1 in which:

said single power source includes:

an electric motor;

and a flywheel continuously driven by said electric motor when said electric motor is energized;

and said selective control means has selective connecting means for selectively connecting said flywheel to said activation control means to produce a cycle of operation of said attaching apparatus.

3. The attaching apparatus according to claim 2 in which said activation control means includes:

a cam connected to said flywheel by said selective connecting means for rotation through one revolution during each cycle of operation, said cam cooperating with said first pivotally mounted arm to move said first pivotally mounted arm during each cycle of operation;

and causing means for causing movement of said second pivotally mounted arm by said single power source during each cycle of operation.

4. The attaching apparatus according to claim 3 in which said causing means of said activation control means includes connecting means for connecting said second pivotally mounted arm to said cam of said activation control means.

5. The attaching apparatus according to claim 4 including fixed stop means for engaging said second pivotally mounted arm at the end of each cycle of operation to dispose said second pivotally mounted arm at a predetermined position at the start of each cycle of operation.

6. The attaching apparatus according to claim 5 including connecting means for connecting said second pivotally mounted arm to said ram means to cause movement of said ram means in response to movement of said second pivotally mounted arm.

7. The attaching apparatus according to claim 6 including resilient means for continuously urging said support means into engagement with said first pivotally mounted arm to enable said first pivotally mounted arm to continuously engage said support means to cause movement of said support means in response to movement of said first pivotally mounted arm.

8. The attaching apparatus according to claim 7 including:

first preventing means for preventing blocking of communication of said first transport means with said first hopper by the first fastener elements within said first hopper;

and second preventing means for preventing blocking of communication of said second transport means with said second hopper by the second fastener elements within said second hopper.

9. The attaching apparatus according to claim 5 including resilient means for continuously urging said support means into engagement with said first pivotally mounted arm to enable said first pivotally mounted arm to continuously engage said support means to cause movement of said support means in response to movement of said first pivotally mounted arm.

10. The attaching apparatus according to claim 2 in which:

said first transport means includes:

first feed means having one end communicating with said first hopper to receive each of the first fastener elements from said first hopper;

a guide channel having one end communicating with the other end of said first feed means to receive one of the first fastener elements from said first feed means and its other end communicating with the setting station;

and reciprocating means for advancing the one first fastener element through said guide channel to the setting station;

said second transport means includes:

second feed means having one end communicating with said second hopper to receive the second fastener elements from said second hopper;

a guide channel having one end communicating with the other end of said second feed means to receive one of the second fastener elements from said second feed means and its other end communicating with the setting station;

and reciprocating means for advancing the one second fastener element through said guide channel to the setting station;

and said second pivotally mounted arm causing advancement and retraction of said reciprocating means of each of said first transport means and said second transport means.

11. The attaching apparatus according to claim 1 including:

first supply means for supplying the first fastener elements in said first hopper to said first transport means from said first hopper;

second supply means for supplying the second fastener elements in said second hopper to said second transport means from said second hopper;

single moving means for moving each of said first supply means and said second supply means so that one of said first supply means and said second supply means supplies fastener elements at a different time than the other of said first supply means and said second supply means and said single moving means includes a second power source separate from said single power source.

12. The attaching apparatus according to claim 11 including:

first fastener removal means for removing any of the first fastener elements preventing transport of the first fastener elements from said first hopper to said first transport means;

second fastener removal means for removing any of the second fastener elements preventing transport of the second fastener elements from said second hopper to said second transport means;

said first supply means including means for activating said first fastener removal means once during each cycle of operation of said single moving means;

and said second supply means including means for activating said second fastener removal means once during each cycle of operation of said single moving means.

13. The attaching apparatus according to claim 12 including means for activating said second power source at least once during each cycle of operation of said attaching apparatus.

14. The attaching apparatus according to claim 12 including means for activating said second power source a plurality of times during each cycle of operation of said attaching apparatus.

15. The attaching apparatus according to claim 1 in which:

said first transport means includes:

first feed means having one end communicating with said first hopper to receive the first fastener elements from said first hopper;

a guide channel having one end communicating with the other end of said first feed means to receive one of the first fastener elements from said first feed means and its other end communicating with the setting station;

and reciprocating means for advancing the one first fastener element through said guide channel to the setting station;

said second transport means includes:

second feed means having one end communicating with said second hopper to receive the second fastener elements from said second hopper;

a guide channel having one end communicating with the other end of said second feed means to receive one of the second fastener elements from said second feed means and its other end communicating with the setting station;

and reciprocating means for advancing the one second fastener element through said guide channel to the setting station;

and said reciprocating means of each of said first transport means and said second transport means being reciprocated by said single power source.

16. The attaching apparatus according to claim 15 including:

first fastener removal means for removing any of the first fastener elements preventing transport of the first fastener elements from said first hopper to said first feed means prior to the supply of the first fastener elements from said first hopper to said first feed means;

and second fastener removal means for removing any of the second fastener elements preventing transport of the second fastener elements from said second hopper to said second feed means prior to the supply of the second fastener elements from said second hopper to said second feed means.

17. The attaching apparatus according to claim 1 including:

first preventing means or preventing blocking of communication of said first transport means with said first hopper by the first fastener elements within said first hopper;

and second preventing means for preventing blocking of communication of said second transport means with said second hopper by the second fastener elements within said second hopper.

18. The attaching apparatus according to claim 1 including:

first fastener removal means for removing any of the first fastener elements preventing transport of the first fastener elements from said first hopper to said first transport means prior to the supply of the first fastener elements from said first hopper to said first transport means;

and second fastener removal means for removing any of the second fastener elements preventing transport of the second fastener elements from said second hopper to said second transport means prior to the supply of the second fastener elements from said second hopper to said second transport means.

19. An attaching apparatus for attaching first and second mating fastener elements to material at a setting station, said apparatus a comprising:

support means and ram means at the setting station;

moving means for creating movement of said support means and said ram means towards each other;

a first hopper having a plurality of first fastener elements therein;

a second hopper having a plurality of second fastener elements therein;

first transport means for transporting each of the first fastener elements from said first hopper to a position at the setting station in a specific orientation for engagement by one of said support means and said ram means;

second transport means for transporting each of the second fastener elements from said second hopper to a position at the setting station in a specific orientation for engagement by the other of said support means and said ram means;

first supply means for supplying the first fastener elements in said first hopper to said first transport means from said first hopper;

second supply means for supplying the second fastener elements in said second hopper to said second transport means from said second hopper;

and single moving means for moving each of said first supply means and said second supply means so that one of said first supply means and said second supply means supplies fastener elements at a different time than the other of said first supply means and said second supply means, said single moving means including a power source.

20. The attaching apparatus according to claim 19 including:

first fastener removal means for removing any of the first fastener elements preventing transport of the first fastener elements from said first hopper to said first transport means;

second fastener removal means for removing any of the second fastener elements preventing transport of the second fastener elements from said second hopper to said second transport means;

said first supply means including means for activating said first fastener removal means once during each cycle of operation of said power source of said single moving means;

and said second supply means including means for activating said second fastener removal means once during each cycle of operation of said power source of said single moving means.

* * * * *

UNITED STATES PATENT AND TRADEMARK OFFICE

CERTIFICATE OF CORRECTION

PATENT NO. : 5,319,848

DATED : June 14, 1994

INVENTOR(S) : Volker Schmidt et al

It is certified that error appears in the above-identified patent and that said Letters Patent is hereby corrected as shown below:

Column 3, line 25, "invention" should read --- invention ---

Column 7, line 18, "105," should read --- 105' ---

Column 13, line 14, "22" should read --- 228 ---

Column 16, line 44, "show" should read --- shown ---

Column 16, line 68, "168A" should read --- 168A, ---

Column 19, lines 26-32, should read

--- and reciprocating means for advancing the one second fastener element through said guide channel to the setting station;

and said second pivotally mounted arm causing advancement and retraction of said reciprocating means of each of said first transport means and said second transport means. ---

UNITED STATES PATENT AND TRADEMARK OFFICE

CERTIFICATE OF CORRECTION

PATENT NO. : 5,319,848

DATED : June 14, 1994

INVENTOR(S) : Volker Schmidt et al

It is certified that error appears in the above-identified patent and that said Letters Patent is hereby corrected as shown below:

:olumn 20, lines 31-36 should read

--- and reciprocating means for advancing the one second fastener element through said guide channel to the setting station;

and said reciprocating means of each of said first transport means and said second transport means being reciprocated by said single power source. ---

:olumn 20, line 53, "or" should read --- for ---

:olumn 21, line 9, cancel "a"

Signed and Sealed this

Twentieth Day of September, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,319,848

DATED : June 14, 1994

INVENTOR(S) : Volker Schmidt et al

It is certified that error appears in the above-identified patent and that said Letters Patent is hereby corrected as shown below:

Column 3, line 25, "invention" should read --- invention,---

Column 7, line 18, "105," should read --- 105' ---

Column 13, line 14, "22" should read --- 228 ---

Column 16, line 44, "show" should read --- shown ---

Column 16, line 68, "168A" should read --- 168A, ---

Column 19, lines 26-32, should read

--- and reciprocating means for advancing the one second fastener element through said guide channel to the setting station;

and said second pivotally mounted arm causing advancement and retraction of said reciprocating means of each of said first transport means and said second transport means. ---

UNITED STATES PATENT AND TRADEMARK OFFICE

CERTIFICATE OF CORRECTION

PATENT NO. : 5,319,848

DATED : June 14, 1994

INVENTOR(S) : Volker Schmidt et al

It is certified that error appears in the above-identified patent and that said Letters Patent is hereby corrected as shown below:

Column 20, lines 31-36 should read

--- and reciprocating means for advancing the one second fastener element through said guide channel to the setting station;

and said reciprocating means of each of said first transport means and said second transport means being reciprocated by said single power source. ---

Column 20, line 53, "or" should read --- for ---

Column 21, line 9, cancel "a"

This certificate supersedes the Certificate Of Correction issued Sept. 20, 1994.

Signed and Sealed this

Thirteenth Day of June, 1995

*Attest:*

*Attesting Officer*

BRUCE LEHMAN

*Commissioner of Patents and Trademarks*